US006973745B2

(12) United States Patent
Mills et al.

(10) Patent No.: US 6,973,745 B2
(45) Date of Patent: Dec. 13, 2005

(54) ATHLETIC SHOE HAVING AN IMPROVED CLEAT ARRANGEMENT

(75) Inventors: David Mills, St. Petors, MO (US); Jacob Ulkus, Clayton, MO (US)

(73) Assignee: Elan-Polo, Inc., St. Louis, MO (US)

( * ) Notice: Subject to any disclaimer, the term of this patent is extended or adjusted under 35 U.S.C. 154(b) by 131 days.

(21) Appl. No.: 10/702,973

(22) Filed: Nov. 6, 2003

(65) Prior Publication Data

US 2005/0097782 A1 May 12, 2005

(51) Int. Cl.[7] ..... A43B 13/22; A43C 13/04

(52) U.S. Cl. ..... 36/116; 36/113; 36/67 A; 36/59 C

(58) Field of Search ..... 36/116, 113, 114, 36/7.7, 7.6, 67 R, 67 A, 67 D, 59 C, 59 B, 36/126, 127, 128

(56) References Cited

U.S. PATENT DOCUMENTS

| | | | | |
|---|---|---|---|---|
| 1,087,212 | A * | 2/1914 | Caldwell | 36/59 R |
| D136,208 | S * | 8/1943 | Ghex et al. | 36/67 A |
| 2,394,454 | A * | 2/1946 | Kappeler | 36/59 C |
| 2,888,756 | A * | 6/1959 | Neal | 36/128 |
| 4,135,317 | A | 1/1979 | Ikeda | |
| 4,180,923 | A * | 1/1980 | Dassler | 36/59 C |
| 4,393,604 | A * | 7/1983 | Crowley | 36/67 R |
| 4,527,344 | A | 7/1985 | Mozena | |
| 4,667,425 | A | 5/1987 | Effler et al. | |
| 5,363,573 | A | 11/1994 | Kilgore et al. | |
| 5,628,129 | A | 5/1997 | Kilgore et al. | |
| 5,752,332 | A * | 5/1998 | Kataoka et al. | 36/59 C |
| 6,314,662 | B1 | 11/2001 | Ellis, III | |
| 6,557,270 | B2 * | 5/2003 | Nakano et al. | 36/67 R |
| 6,705,027 | B1 * | 3/2004 | Campbell | 36/127 |
| 2004/0000075 | A1 * | 1/2004 | Auger et al. | 36/128 |

* cited by examiner

*Primary Examiner*—Anthony Stashick
(74) *Attorney, Agent, or Firm*—Dority & Manning, P.A.

(57) ABSTRACT

An athletic shoe having an improved cleat arrangement is provided. An angled or v-cleat is provided near the first metatarsal region to provide improved traction for a wide variety of sports. In some embodiments, cleats forming an obtuse angle opened towards the medial side of the shoe are also provided for improved forward and lateral traction.

19 Claims, 3 Drawing Sheets

ATHLETIC SHOE HAVING AN IMPROVED CLEAT ARRANGEMENT

FIELD

The present invention relates to an improved cleat arrangement for an athletic shoe. While the present invention is not limited to use with a baseball shoe, certain embodiments of the present invention provide an improved cleat arrangement for a baseball shoe.

BACKGROUND

Sports such as baseball require players to constantly start and stop as well as shift from side to side and move back and forth on unstable surfaces. Athletic shoes for use in baseball and other sports have conventionally been provided with a plurality of cleats to add stability while the wearer is maneuvering during play. Numerous patterns have been developed for positioning cleats on athletic shoes. However, a need exists for an athletic shoe that will better allow the wearer to maintain traction during forward motion while also allowing the wearer to quickly change direction of movement. Thus, an athletic shoe with an improved cleat arrangement that provides the wearer with added traction during the forward pushoff is desirable. In addition, an athletic shoe with an improved cleat arrangement that will provide faster directional response as well as better support and cornering is also desirable.

SUMMARY OF THE INVENTION

Objects and advantages of the invention will be set forth in part in the following description, or may be obvious from the description, or may be learned through practice of the invention.

The present invention relates to an athletic shoe with an improved cleat arrangement. In one exemplary embodiment of the present invention, an athletic shoe with a first metatarsal region is provided. The first metatarsal region has a front and rear portion. The athletic shoe has a medial side and a lateral side as well as a middle portion and a forefoot portion. A v-cleat is configured from a pair of cleats which form a v-shape. The v-cleat is positioned near the rear portion of the first metatarsal region with the open side of the v-cleat arranged toward the front portion of the first metatarsal region. A first toe cleat and a second toe cleat are positioned proximate to one another near the top portion of the first metatarsal region.

In certain embodiments, the v-cleat and first and second toe cleat may have a generally oval shaped ground-engaging surface. The ground-engaging surface of the first toe cleat may be positioned closer to the front portion of the first metatarsal region than the ground-engaging surface of the second toe cleat. The ground-engaging surfaces of the first and second toe cleat may each be angled in a manner such that the front ends of the ground-engaging surfaces are closer together than the rear ends. Also, in certain embodiments, the pair of cleats which form the v-cleat may be conjoined at their base. A medial cleat may be positioned between the front and rear portions of the first metatarsal region and adjacent to the medial side of the athletic shoe. The medial cleat may also have a generally triangular shaped ground-engaging surface. A plurality of center-line cleats may be positioned between the first metatarsal region and the fifth metatarsal region of the athletic shoe. The center-line cleats may be generally positioned along a line extending from the middle portion to the forefoot portion of the athletic shoe.

In another exemplary embodiment of the present invention, an athletic shoe with a first metatarsal region is provided. The first metatarsal region has a front portion and a rear portion. The athletic shoe has a medial side and a lateral side. An acute angled cleat is configured from two cleats which generally form an acute angle. The acute angled cleat is positioned near the rear portion of the first metatarsal region with the open side of the acute angled arranged toward the front portion of the first metatarsal region. A first toe cleat and second toe cleat are positioned proximate to one another near the front portion of the first metatarsal region. A medial cleat is positioned between the front and rear portions of the first metatarsal region and is adjacent to the medial side of the athletic shoe.

In still another exemplary embodiment of the present invention, a cleat arrangement located on the bottom of an athletic shoe is provided. The athletic shoe has a first metatarsal region and a fifth metatarsal region. In addition, the athletic shoe has a medial side, a lateral side, a forefoot portion, a middle portion, and a heel portion. An acute angled cleat is configured from two cleats which generally form an acute angle. The acute angled cleat is positioned near the rear portion of the first metatarsal region with the open side of the acute angled cleat arranged toward the front portion of the first metatarsal region. A first toe cleat and second toe cleat are positioned proximate to one another near the front portion of the first metatarsal region. A medial cleat is positioned between the front and rear portions of the first metatarsal region and is adjacent to the medial side of the athletic shoe. An obtuse angled cleat is configured from two cleats which generally form an obtuse angle. The obtuse angled cleat is positioned near the rear portion of the fifth metatarsal region with the open side of the obtuse angled cleat arranged toward the medial side of the athletic shoe. A third toe cleat is positioned near the front of the fifth metatarsal region. A lateral cleat is positioned between the front and rear portions of the fifth metatarsal region and is adjacent to the lateral edge of the athletic shoe.

These and other features, aspects, and advantages of the present invention will become better understood with reference to the following description and appended claims. The accompanying drawings, which are incorporated in and constitute a part of this specification, illustrate an embodiment of the invention and, together with the description, serve to explain the principles of the invention.

BRIEF DESCRIPTION OF THE DRAWINGS

A full and enabling disclosure of this invention, including the best mode known to one of ordinary skill in the art, is set forth in this specification. The following Figures illustrate an exemplary embodiment of the present invention.

DETAILED DESCRIPTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in or are obvious from the following detailed description.

The present invention is directed to an athletic shoe with a uniquely effective cleat arrangement. The present invention provides improved traction and support for athletic activities. While the present invention is particularly well suited for a baseball shoe, it could be utilized for athletic shoes in football, rugby, golf, and many other sports.

The present invention is adapted to advantageously provide traction for forward and lateral movement by focusing on areas of the foot where such movement originates and is supported. The bone structure of the foot is important in determining the pressure points of the shoe where the wearer's weight is applied. Very generally, weight is projected to the foot between the rearfoot and the forefoot. The forefoot is comprised of the lesser tarsus and five major bones referred to as the first, second, third, fourth, and fifth metatarsal. Of the weight carried by the forefoot, much of the weight is transferred to the first and fifth metatarsal areas of the foot. As used herein, medial refers to the inside of the wearer's foot and lateral refers to the outside of the wearer's foot. The present invention achieves greatly improved traction and support by focusing cleat placement to the first and fifth metatarsal areas of the foot.

Figure 1:
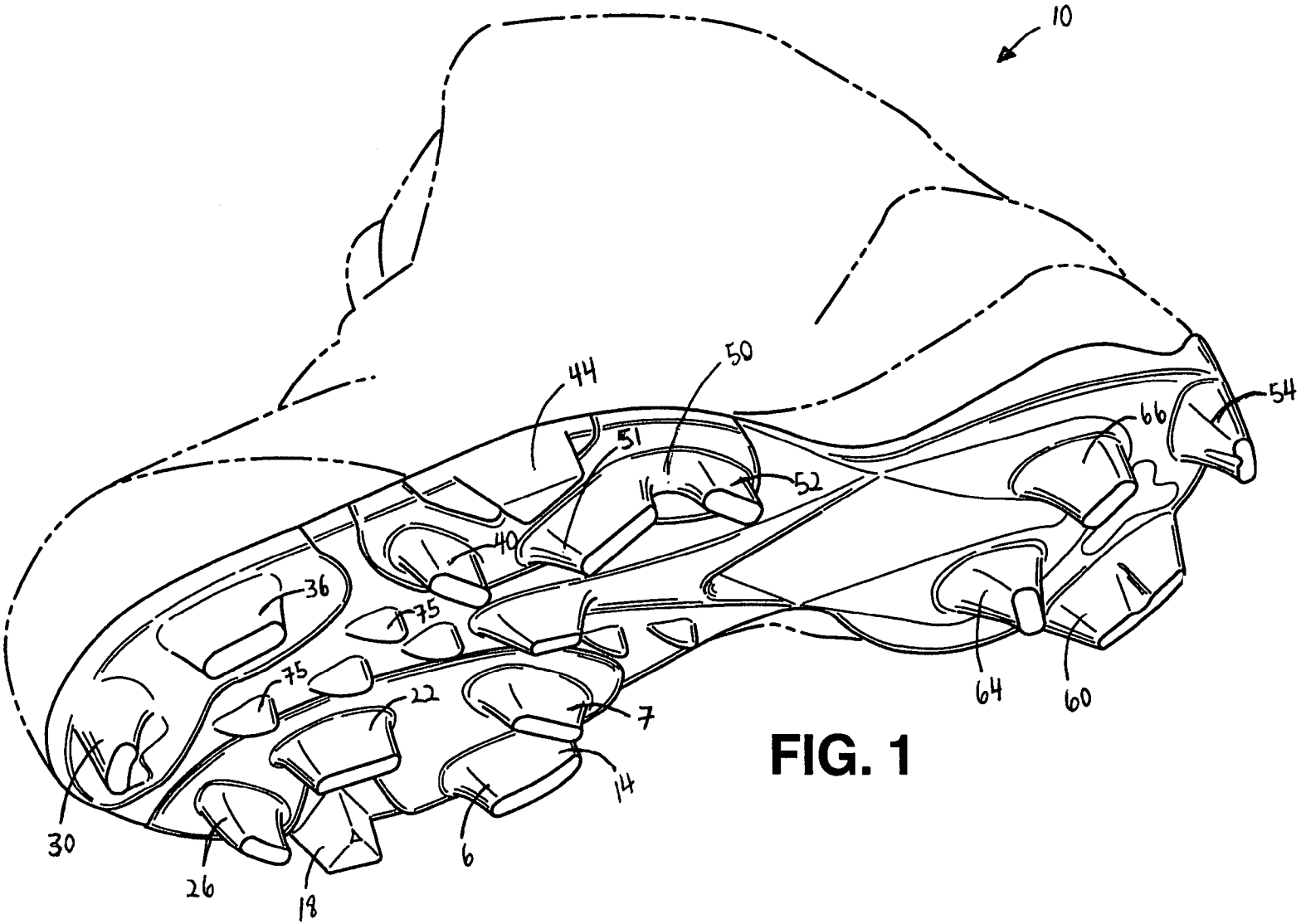
FIGS. 1 and 2 are perspective views showing an exemplary embodiment of an athletic shoe.
Figure 2:
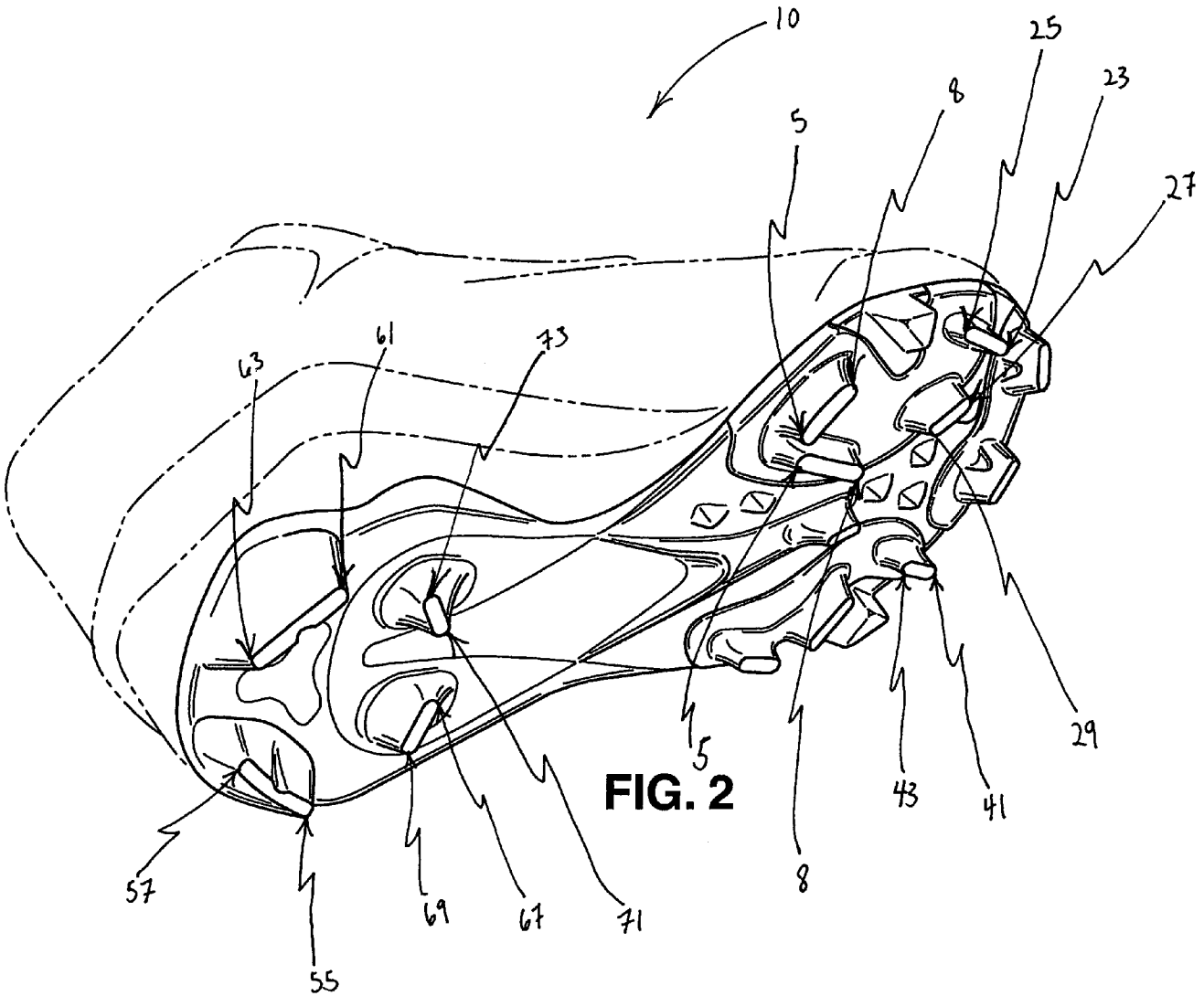
Figure 3:
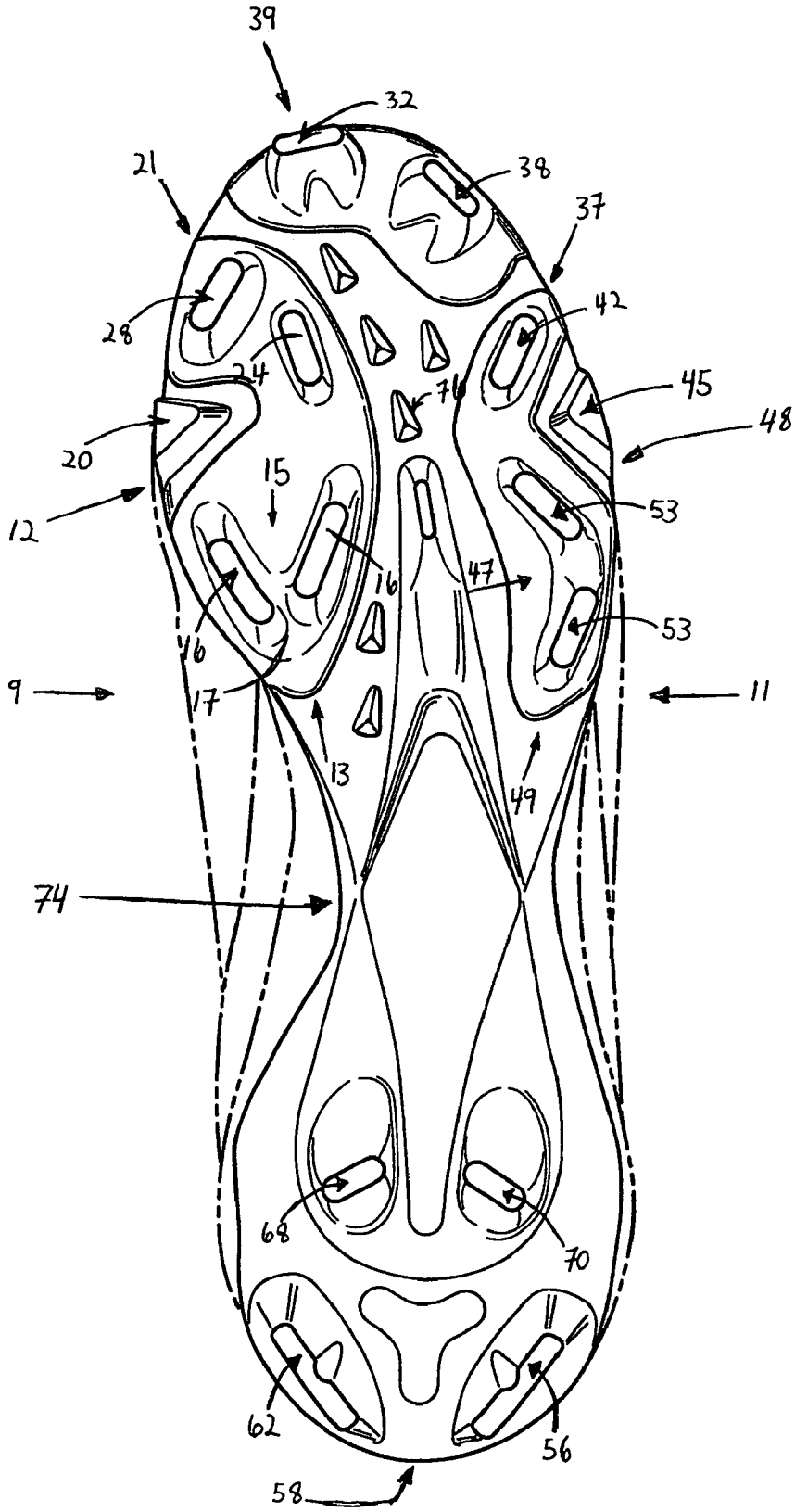
FIG. 3 is a bottom view of an exemplary embodiment of an athletic shoe.

With reference to FIGS. 1–3, an exemplary embodiment of the present invention is provided in an athletic shoe 10 that is illustrated having a unique cleat arrangement. Generally, a cleat is a projection from the bottom of a shoe that provides added traction. The cleats of the present invention can be made of TPU, metal, rubber or any other material as will be understood by one of ordinary skill in the art using the teachings disclosed herein. The cleats may be molded from the same material as the sole of the athletic shoe or may be secured to the sole by glue or some other method known to one of ordinary skill in the art. In addition, a textured surface or other features may be added to provide a non-slip surface on the ground-engaging portion of the cleat.

In one exemplary embodiment of the present invention, cleats are positioned at the first metatarsal region 12 of the athletic shoe 10. Cleats 6 and 7 are configured to form a v-shape and comprise a v-cleat 14, also referred to as an acute angled cleat. It should be understood that the present invention is not limited to the precise v-shape shown in the figures; instead, multiple cleat configurations fall within the claims as set forth below and as will be understood by one of ordinary skill in the art. The v-cleat 14 has generally oval-shaped ground-engaging surfaces 16. The ground-engaging surfaces 20 have a front end 8 and a rear end 5. In the exemplary embodiment of FIGS. 1–3, the two cleats 6 and 7 which form the v-cleat 14 are conjoined at their base 17. The v-cleat 14 is positioned near the bottom portion 13 of the first metatarsal region 12 of the athletic shoe 10 with the open side 15 of the v-cleat 14 arranged toward the top portion 21 of the first metatarsal region 12. In other exemplary embodiments of the present invention, the ground-engaging surfaces 20 of the v-cleat 14 are connected at their rear ends 5 and the v-cleat is not conjoined at the base.

The v-cleat 14 improves traction and directional response for the wearer of the athletic shoe 10. The initial movement from a stationary position involves establishing traction for pushing off with the foot. To maximize the amount of traction, it is important to position cleats on the shoe based, in part, upon the bone structure of the foot. The unique shape of the v-cleat 14 surrounds the bottom portion 13 of the first metatarsal region 12 allowing the wearer more traction and stability. The v-cleat 14 allows optimal traction for the wearer during both forward pushoff, as the wearer begins running or fielding, and also at slowdown as the wearer comes to a stop or breaks his run. As the wearer's weight is largely retained over the first metatarsal region of the shoe, the v-cleat 14 provides optimal control. In addition, the v-cleat 14 allows for better cutting or direction of run change to the wearer. These advantages are provided because of the shape and orientation of the v-cleat 14, which acts as a wedge against the ground or other surface.

A first toe cleat 22 and second toe cleat 26 are positioned proximate to one another near the top portion 21 of the first metatarsal region 12 of the athletic shoe 10. The toe cleats increase traction for forward movement for the wearer of the athletic shoe 10. The first toe cleat 22 and second toe cleat 26 each have a generally oval-shaped ground-engaging surfaces 24 and 28. The ground-engaging surface 24 of the first toe cleat 22 has a front 27 and rear 29. The ground-engaging surface 28 of the second toe cleat 26 has a front 23 and rear 25. The second toe cleat ground-engaging surface 28 is positioned closer to the top portion 21 of the first metatarsal region 12 of the athletic shoe 10 than the second toe cleat ground-engaging surface 28 and the first toe cleat ground-engaging surface 24 and the second toe cleat ground-engaging surface 28 are angled towards one another in a manner such that the front ends 27, 23 of the ground-engaging surfaces are closer together than the rear ends 29, 25. The toe cleats 22, 26 provide the wearer with quicker and more positive starting power. Maximum traction for an initial burst of acceleration by the wearer is optimally achieved by the added resistance provided by the toe cleats 22, 26 during the rearward push with the athletic shoe 10.

A medial cleat 18 is positioned between the top portion 21 and bottom portion 13 of the first metatarsal region 12 of the athletic shoe 10, adjacent to the medial side 9 of the athletic shoe 10. The medial cleat 18 is positioned to provide optimal support and cornering for the wearer of the athletic shoe 10. The medial cleat 18 provides optimum traction for the variation of directional movements of the wearer. During sideward movement, the medial cleat 18 helps prevent the wearer's foot from rolling and allows full sideward movement by utilizing the shifting weight pattern of the foot. The medial cleat 18 has a generally triangular shaped ground-engaging surface 20.

The athletic shoe 10 includes a plurality of center-line cleats 75 positioned between the first metatarsal region 12 and the fifth metatarsal region 48 of the athletic shoe 10. The cleats 75 are generally positioned along a line extending from the middle portion 74 to the forefoot portion 39 of the athletic shoe 10 and are generally centered between the medial side 9 and lateral side 11 of the shoe. The base 76 of each cleat 75 is generally triangular in shape.

Athletic shoe 10 includes cleats positioned at the fifth metatarsal region 48 of the athletic shoe 10. Two cleats 51, 52 may be arranged in a manner to form an obtuse angle and to create an obtuse angled cleat 50. The obtuse angled cleat 50 has generally oval-shaped ground-engaging surfaces 53. The obtuse angled cleat 50 is positioned near the bottom portion 49 of the fifth metatarsal region 48 of the athletic shoe 10 with the open side 47 of the obtuse angled cleat 50 opening towards the medial side 9 of the athletic shoe 10.

The obtuse angled cleat 50 is positioned to provide optimal support and cornering for the wearer of the athletic shoe 10. More specifically, obtuse angled cleat 50 is particularly beneficial in providing traction for lateral movement by the wearer.

A third toe cleat 40 is positioned near the top portion 37 of the fifth metatarsal region 48 of the athletic shoe 10. The third toe cleat 40 has a generally oval-shaped ground-engaging surface 42. The ground-engaging surface has a front 41 and rear 43. A lateral cleat 44 is positioned between the top portion 39 and bottom portion 49 of the fifth metatarsal region 48 of the athletic shoe 10 adjacent to the lateral side 11 athletic shoe 10. The front 41 of the ground-engaging surface 42 of the third toe cleat 40 is angled toward the lateral cleat 44. The lateral cleat 44 has a generally triangular shaped ground-engaging surface 45.

A fourth toe cleat 36 and fifth toe cleat 30 are positioned proximate to one another near the forefoot portion 39 of the athletic shoe 10. The fourth toe cleat 36 has a ground-engaging surface 38 and the fifth toe cleat 30 has a ground-engaging surface 32. A first heel cleat 54 and second heel cleat 60 are positioned near the heel portion 58 of the athletic shoe 10. The first heel cleat 54 has a ground-engaging surface 56 and the second heel cleat 60 has a ground-engaging surface 62. The ground-engaging surface 56 of the first heel cleat 54 has a front 55 and rear 57 and the ground-engaging surface 62 of the second heel cleat 60 has a front 61 and rear 63. The first heel cleat 54 and second heel cleat 60 are substantially symmetrically placed opposite one another with the first heel cleat 54 positioned at the lateral side 11 of the athletic shoe 10 and the second heel cleat 60 is positioned at the medial side 9 of the athletic shoe. The first heel cleat ground-engaging surface 56 and the second toe cleat ground-engaging surface 62 are angled towards one another in a manner such that the front ends 55, 61 of the ground-engaging surfaces 56,62 are farther apart than the rear ends 57,63.

A third heel cleat 66 and fourth heel cleat 64 are positioned near the heel portion 58 of the athletic shoe 10 between the middle portion 74 and heel portion 58 of the athletic shoe. The third heel cleat 66 has a ground-engaging surface 70 and the fourth heel cleat 64 has a ground-engaging surface 68. The ground-engaging surface 70 of the third heel cleat 66 has a front 67 and rear 69 and the ground-engaging surface 68 of the fourth heel cleat 64 has a front 71 and rear 73. The third heel cleat ground-engaging surface 70 and the fourth heel cleat ground-engaging surface 64 are angled towards one another in a manner such that the front ends 67, 71 of the ground-engaging surfaces 70, 68 are closer together than the rear ends 69, 73.

Exemplary embodiments of the present invention have been described in which an athletic shoe with an improved cleat arrangement is provided. An acute angled or v-cleat located near the first metatarsal region provides improved traction, particularly for starting and stopping. In certain embodiments, an obtuse angled cleat located on the lateral side of the shoe and opened towards the medial side of the shoe provides improved traction, particularly for lateral movement.

While exemplary embodiments of the present invention have been described utilizing various cleat configurations, it should be understood that the present invention is not limited to only these configurations as will be understood by one of ordinary skill in the art using the teaching disclosed herein. It should be appreciated by those skilled in the art that modifications and variations can be made to the exemplary embodiment of athletic shoe 10 as described herein, without departing from the scope and spirit of the claims. It is intended that the invention include such modifications and variations as come within the scope of the appended claims and their equivalents.

What is claimed is:

1. An athletic shoe, said athletic shoe having a first metatarsal region having a front portion and a rear portion, said athletic shoe having a medial side and lateral side, said athletic shoe having a middle portion and a forefoot portion, said athletic shoe comprising:

a v-cleat configured from a pair of cleats which are configured to form a v-shape, said v-cleat having an open side, said v-cleat being positioned near said rear portion of said first metatarsal region with said open side of said v-cleat arranged toward said front portion of said first metatarsal region;

a first toe cleat and a second toe cleat positioned proximate to one another near said top portion of said first metatarsal region;

a plurality of center-line cleats, said cleats positioned between said first metatarsal region and said fifth metatarsal region of said athletic shoe, said cleats generally positioned along a line extending from said middle portion to said forefoot portion of said athletic shoe and generally centered between said medial side and said lateral side of said athletic shoe.

2. The athletic shoe of claim 1, wherein said v-cleat and said first and second toe cleats each have generally oval-shaped ground-engaging surfaces, said ground-engaging surfaces each having a front end and a rear end.

3. The athletic shoe of claim 2, wherein said ground-engaging surface of said first toe cleat is positioned closer to said front portion of said first metatarsal region than said ground-engaging surface of said second toe cleat, and said ground-engaging surfaces of said first and second toe cleat are each angled towards one another in a manner such that said front ends of said ground-engaging surfaces are closer together than said rear ends.

4. The athletic shoe of claim 1, wherein a medial cleat is positioned between said front and rear portions of said first metatarsal region and adjacent to said medial side of said athletic shoe.

5. The athletic shoe of claim 4, wherein said medial cleat has a generally triangular shaped ground-engaging surface.

6. The athletic shoe of claim 1, wherein said pair of cleats which form said v-cleat are conjoined at their base.

7. An athletic shoe, said athletic shoe having a first metatarsal region having a front portion and a rear portion, said athletic shoe having a medial side and lateral side, said athletic shoe comprising:

an acute angled cleat configured from two cleats which generally form an acute angle, said acute angled cleat having an open side, said acute angled cleat positioned near said rear portion of said first metatarsal region with said open side of said acute angled cleat arranged toward said front portion of said first metatarsal region;

a first toe cleat and a second toe cleat positioned proximate to one another near said front portion of said first metatarsal region;

a medial cleat positioned between said front and rear portions of said first metatarsal region and adjacent to said medial side of said athletic shoe.

8. The athletic shoe of claim 7, wherein said acute angled cleat and said first and second toe cleats each have generally oval-shaped ground-engaging surfaces, said ground-engaging surfaces each having a front and a rear end, and said medial cleat has a generally triangular shaped ground-engaging surface.

9. The athletic shoe of claim 8, wherein said ground-engaging surface of said first toe cleat is positioned closer to said front portion of said first metatarsal region than said ground-engaging surface of said second toe cleat, and said ground-engaging surfaces of said first and said second toe cleats are angled towards one another in a manner such that said front ends of said ground-engaging surfaces are closer together than said rear ends.

10. The athletic shoe of claim 7, further comprising a lateral cleat, said lateral cleat positioned adjacent to said lateral side of said athletic shoe, said lateral cleat symmetrically positioned across from said medial cleat.

11. The athletic shoe of claim 8, wherein said ground-engaging surfaces are textured.

12. A cleat arrangement, said cleat arrangement located on the bottom of an athletic shoe, said athletic shoe having a first metatarsal region and a fifth metatarsal region, said first metatarsal region and said fifth metatarsal region both having a front portion and a rear portion, said athletic shoe having a medial side and a lateral side, said athletic shoe having a forefoot portion, a middle portion, and a heel portion, said cleat arrangement comprising:

an acute angled cleat configured from two cleats which generally form an acute angle, said acute angled cleat having an open side, said acute angled cleat positioned near said rear portion of said first metatarsal region with said open side of said acute angled cleat arranged toward the front portion of the first metatarsal region;

a first toe cleat and a second toe cleat positioned proximate to one another near said front portion of said first metatarsal region;

a medial cleat positioned between said front and rear portions of said first metatarsal region and adjacent to said medial side of said athletic shoe;

an obtuse angled cleat configured from two cleats which generally form an obtuse angle; said obtuse angled cleat having an open side, said obtuse angled cleat positioned near said rear portion of said fifth metatarsal region with said open side of said obtuse angled cleat arranged toward said medial side of said athletic shoe;

a third toe cleat positioned near said front of said fifth metatarsal region;

a lateral cleat positioned between said front and said rear portions of said fifth metatarsal region and adjacent to said lateral edge of said athletic shoe.

13. The cleat arrangement of claim 12, wherein said acute angled cleat and said obtuse angled cleat, and said first, second, and third toe cleats each have generally oval-shaped ground-engaging surfaces, said ground-engaging surfaces each having front and rear ends, and said medial and said lateral cleats each have generally triangular shaped ground-engaging surfaces.

14. The cleat arrangement of claim 13, wherein said ground-engaging surface of said first toe cleat is positioned closer to said top portion of said first metatarsal region than said ground-engaging surface of said second toe cleat and said ground-engaging surfaces of said first and second toe cleat are angled towards one another in a manner such that said front ends of said ground-engaging surfaces are closer together than said rear ends.

15. The cleat arrangement of claim 13, wherein said front end of said ground-engaging surface of said third toe cleat is angled toward said lateral cleat.

16. The cleat arrangement of claim 12, further comprising a fourth and a fifth toe cleat, said fourth and fifth toe cleat positioned proximate to one another near said forefoot portion of said athletic shoe.

17. The cleat arrangement of claim 12, further comprising a first and second heel cleat, said first and second heel cleat positioned proximate to one another near said heel portion of said athletic shoe.

18. The cleat arrangement of claim 12, further comprising a third and fourth heel cleat, said third and fourth heel cleat positioned between said middle portion and said heel portion of said athletic shoe.

19. The cleat arrangement of claim 13, wherein said ground-engaging surfaces are textured.

* * * * *